US012091941B2

(12) United States Patent
Lund

(10) Patent No.: US 12,091,941 B2
(45) Date of Patent: Sep. 17, 2024

(54) DOWNHOLE WELLBORE TREATMENT SYSTEM AND METHOD

(71) Applicant: PIPETECH INTERNATIONAL AS, Sandnes (NO)

(72) Inventor: Knut Lund, Sandnes (NO)

(73) Assignee: PIPETECH INTERNATIONAL AS, Sandnes (NO)

( * ) Notice: Subject to any disclaimer, the term of this patent is extended or adjusted under 35 U.S.C. 154(b) by 609 days.

(21) Appl. No.: 17/192,962

(22) PCT Filed: Sep. 5, 2019

(86) PCT No.: PCT/EP2019/073704
§ 371 (c)(1),
(2) Date: Mar. 5, 2021

(87) PCT Pub. No.: WO2020/049102
PCT Pub. Date: Mar. 12, 2020

(65) Prior Publication Data

US 2022/0106859 A1 Apr. 7, 2022

(30) Foreign Application Priority Data

Sep. 6, 2018 (GB) ..... 1814544
Nov. 22, 2018 (GB) ..... 1819056

(51) Int. Cl.
*E21B 37/04* (2006.01)
*E21B 4/02* (2006.01)
(Continued)

(52) U.S. Cl.
CPC ..... *E21B 37/04* (2013.01); *E21B 4/02* (2013.01); *E21B 17/05* (2013.01); *E21B 19/22* (2013.01);
(Continued)

(58) Field of Classification Search
CPC ..... E21B 41/0078; E21B 37/00; E21B 37/08; E21B 37/04; E21B 37/02; E21B 7/065; B08B 9/0433; B08B 9/045
See application file for complete search history.

(56) References Cited

U.S. PATENT DOCUMENTS 3,892,274 A 7/1975 Dill
3,958,641 A 5/1976 Dill et al.
(Continued)

FOREIGN PATENT DOCUMENTS

EP 2866956 1/2014
GB 2237594 A 5/1991

OTHER PUBLICATIONS

Dictionary definition of "hose", accessed Jul. 20, 2023 via thefreedictionary.com.*
(Continued)

*Primary Examiner* — Blake Michener
(74) *Attorney, Agent, or Firm* — Hunton Andrews Kurth LLP

(57) ABSTRACT

A downhole wellbore treatment system for and a method of treating an inner surface (FT) of a wellbore (W) is provided. The system comprises an elongate conduit (50) such as a flexible hose (50) for conveying treatment fluid from the surface (P; C) to a treatment head (80) adapted to be inserted into the wellbore (W). The treatment head (80) has a nozzle (83) providing an outlet from the conduit (50) for creating a jet of treatment fluid directed at the inner surface (FT) of the wellbore (W). The treatment head (50) is rotationally disconnected from the conduit (50) by a swivel device (70), allowing rotation of the head (50) relative to the conduit (50) during jetting of the treatment fluid. The elongate conduit (50) is reelable (10) and is inserted into the downhole wellbore (W) from a reel (10) at the surface, through a pressure control device (40) containing wellbore pressure
(Continued)

within the downhole wellbore (W) during insertion of the elongate conduit (50) from the reel (10).

17 Claims, 12 Drawing Sheets

(51) Int. Cl.

| | |
|---|---|
| ***E21B 17/05*** | (2006.01) |
| ***E21B 19/22*** | (2006.01) |
| ***E21B 21/02*** | (2006.01) |
| ***E21B 23/08*** | (2006.01) |
| ***E21B 33/068*** | (2006.01) |
| ***E21B 41/00*** | (2006.01) |
| ***E21B 43/12*** | (2006.01) |

(52) U.S. Cl.
CPC ..... *E21B 21/02* (2013.01); *E21B 23/08* (2013.01); *E21B 33/068* (2013.01); *E21B 41/0078* (2013.01); *E21B 43/124* (2013.01)

(56) References Cited

U.S. PATENT DOCUMENTS 4,441,557 A 4/1984 Zublin
4,508,577 A * 4/1985 Conn ..... B08B 9/0433 134/22.12
4,705,107 A * 11/1987 Council ..... B08B 9/045 166/170
4,715,538 A * 12/1987 Lingnau ..... B26F 3/004 134/167 C
4,883,355 A * 11/1989 Saghatchi ..... E21B 23/08 356/241.6
4,919,204 A 4/1990 Baker et al.
5,125,425 A * 6/1992 Folts ..... B08B 9/0433 239/DIG. 19
5,143,105 A * 9/1992 Katayama ..... B08B 9/0495 134/179
5,322,080 A * 6/1994 Rankin ..... B08B 9/0433 242/379.2
5,323,797 A 6/1994 Rankin
5,474,097 A * 12/1995 Lowe ..... E21B 17/006 134/167 C
6,173,771 B1 * 1/2001 Eslinger ..... F28G 3/163 166/173
6,397,864 B1 6/2002 Johnson
7,513,261 B2 4/2009 Ura
9,080,413 B2 7/2015 Winnon
2003/0056811 A1 * 3/2003 Walker ..... E21B 37/00 134/22.12
2008/0308269 A1 * 12/2008 D'Amico ..... E21B 37/00 166/170
2016/0153239 A1 * 6/2016 Randall ..... E21B 23/14 166/308.1

OTHER PUBLICATIONS

Excerpt from web site—Aqua Milling PIPETECH, downloaed from http://www.pipetech.no/services/aquamilling/ (Dec. 13, 2016).
Excerpt from web site—Giant Group Services, downloaded from https://web.archive.org/web/20161018212336/http:/giantgroupme.com/hydromilling.php (Dec. 13, 2016).
Int'l Search Report (PCT/EP2019/073704), dated Dec. 12, 2019.

* cited by examiner

DETAIL A

DETAIL B

SECTION A-A
COOLING JACKET INLET PORTS

SECTION B-B
WEEP HOLES

SECTION C-C
FILL PORT, COOLING JACKET WEEP PORTS

DETAIL A

DETAIL B

DOWNHOLE WELLBORE TREATMENT SYSTEM AND METHOD

The present invention relates to a downhole wellbore cleaning system for use in an oil or gas or water well, for cleaning the inner surface of a wellbore and to a method of cleaning a downhole wellbore. The invention is applicable to land and offshore wells.

BACKGROUND

During the production of fluids from underground wells, various deposits accumulate on the inner surface of various downhole tubulars and these deposits are frequently required to be removed during periodic cleaning of the wellbore. There are various known devices for cleaning the wellbore. For example, U.S. Pat. Nos. 7,878,238, 4,441,557, 9,080,413 and 3,892,274 all disclose earlier known devices. U.S. Pat. No. 3,958,641 discloses a known device for cleaning a downhole wellbore which is useful for understanding the invention.

SUMMARY

The invention provides a downhole wellbore treatment system for treating an inner surface of a wellbore, the system comprising an elongate conduit for conveying treatment fluid from the surface to a treatment head adapted to be inserted into the wellbore, the treatment head having a nozzle providing an outlet from the conduit for creating a jet of treatment fluid directed at the inner surface of the wellbore, wherein the treatment head is rotationally disconnected from the conduit by a swivel device, allowing rotation of the head relative to the conduit during jetting of the treatment fluid; wherein the elongate conduit is reelable and is inserted into the downhole wellbore from a reel at the surface, through a pressure control device containing wellbore pressure within the downhole wellbore during insertion of the elongate conduit from the reel.

Optionally the treatment is cleaning. Optionally the fluid is a cleaning fluid and the treatment head is optionally a cleaning head. Optionally the treatment relates to the removal of scale from the inner surface of the wellbore.

Optionally the system is used to clean or otherwise treat the inner surface of a downhole tubular in the wellbore, such as production tubing, casing, liner, or other tubular. Optionally downhole wellbore components with bores can be treated as well, such as valves etc.

The reelable elongate conduit can be continuously inserted into the wellbore during treatment e.g. cleaning. Continuous treatment operations where the treatment head is advancing into the tubular being treated, means that the treatment process can be faster and more consistent.

Optionally the treatment head is connected to the conduit by a flexible hose. Optionally, the treatment head is rotated by a turbine disposed in fluid communication with the conduit. Optionally, flow of fluid through the conduit drives rotation of the turbine and preferably also the treatment head relative to the conduit. Optionally the turbine comprises a drive head which optionally further comprises one or more angled ports which may be arranged to provide an exit path for treatment fluid.

Optionally at least one port on the drive head is directed away from a distal end of the treatment head, for example toward the point of entry of the elongate conduit into the wellbore. Optionally, force created by the jet of treatment fluid from the at least one port drives the drive head (and preferably, also drives the treatment head) through the wellbore. Optionally, this pulls the elongate conduit through the wellbore, while treatment is taking place. Therefore, in some examples, the force from the pressure of the treatment fluid being jetted from the at least one port performs the separate tasks of:— i) propelling the elongate conduit and treatment head through the wellbore being cleaned; and/or
ii) rotates the drive head and treatment head; and
iii) cleans the inner surface of the wellbore. This permits continuous treatment while the treatment head advances through the tubular being cleaned.

Preferably the force from the pressure of the treatment fluid within the elongate conduit performs the additional task of iv) driving a turbine and causing rotation of the treatment head relative to the elongate conduit.

Preferably, the force from the pressure of the treatment fluid within the elongate conduit performs the separate tasks of i) forcing the treatment head against the inner surface of the wellbore and ii) treats the inner surface of the wellbore and preferably also iii) rotates the drive head and treatment head.

Preferably, the treatment head includes at least one outlet nozzle and one radial thrust nozzle, wherein the force of the pressure of the treatment fluid within the elongate conduit exiting the radial thrust nozzle thrusts the treatment head off the longitudinal central axis of the elongate conduit and thus forces the outlet nozzle toward the inner surface of the wellbore.

Typically, the diameter of the outlet nozzle is smaller than the diameter of the radial thrust nozzle. Preferably, the treatment head comprises a substantially cylindrical shape and more preferably, the outlet nozzle is an aperture formed through a sidewall provided on one side of the substantially cylindrical treatment head and more preferably the radial thrust nozzle is an aperture formed through a sidewall provided on a second side of the substantially cylindrical treatment head and most preferably the outlet nozzle is substantially opposite the radial thrust nozzle with reference to the longitudinal central axis of the substantially cylindrical treatment head.

Optionally, the pressure control device comprises at least one of (and optionally all of) a stuffing box, a lubricator and a BOP. The stuffing box typically comprises seals to contain the wellbore pressure within the well above the lubricator. The lubricator typically comprises an elongate pipe adapted to resist wellbore pressure and where the lubricator is disposed below the stuffing box and above the BOP, and the lubricator is further adapted to receive the elongate member and optionally the bottom hole assembly of the system. The stuffing box typically comprises seals (e.g. grease injection seals) to resist wellbore pressure. The BOP optionally comprises rams or other pressure containment devices adapted to close an annulus around the elongate conduit in the event of loss of containment of downhole wellbore pressure. Optionally the BOP can be adapted to shear the elongate conduit.

Optionally, the treatment head is disposed on a bottom hole assembly on the end of the elongate conduit. Optionally the bottom hole assembly comprises at least one of a one-way valve, an emergency disconnect device, a jarring device at least one weighted component such as a weight stem and a stabiliser. The one-way valve optionally controls the passage of fluid through the elongate conduit. Optionally the bottom hole assembly is more rigid than the elongate conduit. Optionally the emergency disconnect device permits disconnection of an upper part of the bottom hole assembly from a lower part of the bottom hole assembly.

Optionally the stabiliser maintains a minimum standoff between the outer surface of the bottom hole assembly and the inner surface of the tubular being cleaned. Optionally, the weighted component adds additional weight to the bottom hole assembly to assist in deployment of the bottom hole assembly into the wellbore under gravity.

Optionally the elongate conduit is flexible. Optionally the elongate conduit is laterally flexible, allowing lateral deviation of the conduit from a straight line, but is axially less flexible, being more resistant to changes in length as a result of advancing into the wellbore. Optionally the elongate conduit comprises coiled tubing, typically formed of steel. Optionally the elongate conduit comprises a flexible hose. Optionally the elongate conduit is reeled onto the reel in a continuous length. Optionally the elongate conduit is adapted to convey high pressure fluids at high flow rates (e.g. 100-300 l/min) to the treatment head, for example, at pressures from 500 Bar (50 MPa) to 1500 Bar (150 Mpa), for example, around 1000 Bar (100 Mpa).

The invention also provides a method of treating an inner surface of a wellbore, the method comprising advancing an elongate conduit into the wellbore, conveying treatment fluid from the surface to a treatment head connected to the conduit, jetting treatment fluid from an outlet nozzle on the treatment head in fluid communication with the elongate conduit at the inner surface of the wellbore, rotating the treatment head relative to the elongate conduit during treatment; wherein the elongate conduit is reelable and wherein the method includes inserting the elongate conduit into the wellbore from a reel at the surface, through a pressure control device containing wellbore pressure within the wellbore during insertion of the elongate conduit into the wellbore.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one aspect can typically be combined alone or together with other features in different aspects of the invention. Any subject matter described in this specification can be combined with any other subject matter in the specification to form a novel combination.

Various aspects of the invention will now be described in detail with reference to the accompanying figures. Still other aspects, features and advantages of the present invention are readily apparent from the entire description thereof, including the figures, which illustrate a number of exemplary aspects and implementations. The invention is also capable of other and different examples and aspects and its several details can be modified in various respects, all without departing from the spirit and scope of the present invention. Accordingly, each example herein should be understood to have broad application and is meant to illustrate one possible way of carrying out the invention, without intending to suggest that the scope of this disclosure, including the claims, is limited to that example. Furthermore, the terminology and phraseology used herein is solely used for descriptive purposes and should not be construed as limiting in scope. In particular, unless otherwise stated, dimensions and numerical values included herein are presented as examples illustrating one possible aspect of the claimed subject matter, without limiting the disclosure to the particular dimensions or values recited. All numerical values in this disclosure are understood as being modified by "about". All singular forms of elements, or any other components described herein are understood to include plural forms thereof and vice versa.

Language such as "including", "comprising", "having", "containing" or "involving" and variations thereof, is intended to be broad and encompass the subject matter listed thereafter, equivalents and additional subject matter not recited and is not intended to exclude other additives, components, integers or steps. Likewise, the term "comprising" is considered synonymous with the terms "including" or "containing" for applicable legal purposes. Thus, throughout the specification and claims unless the context requires otherwise, the word "comprise" or variations thereof such as "comprises" or "comprising" will be understood to imply the inclusion of a stated integer or group of integers but not the exclusion of any other integer or group of integers.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including" or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

References to directional and positional descriptions such as upper and lower and directions e.g. "up", "down" etc. are to be interpreted by a skilled reader in the context of the examples described to refer to the orientation of features shown in the drawings and are not to be interpreted as limiting the invention to the literal interpretation of the term, but instead should be as understood by the skilled addressee. In particular, positional references in relation to the well such as "up" and similar terms will be interpreted to refer to a direction toward the point of entry of the borehole into the ground or the seabed and "down" and similar terms will be interpreted to refer to a direction away from the point of entry, whether the well being referred to is a conventional vertical well or a deviated well.

BRIEF DESCRIPTION OF THE DRAWINGS

In the accompanying drawings:

FIG. 5(*b*) shows a more detailed cross-sectional view of the nozzle assembly of FIG. 4;

FIG. 7(*b*) is a cross-sectional view of the swivel of FIG. 7(*a*);

FIG. 8(*b*) is a cross-sectional view of the swivel of FIG. 8(*a*);

FIG. 9(*b*) is a cross-sectional view of the swivel of FIG. 9(*a*);

DETAILED DESCRIPTION OF ONE OR MORE EXAMPLES OF THE INVENTION

Figure 1:
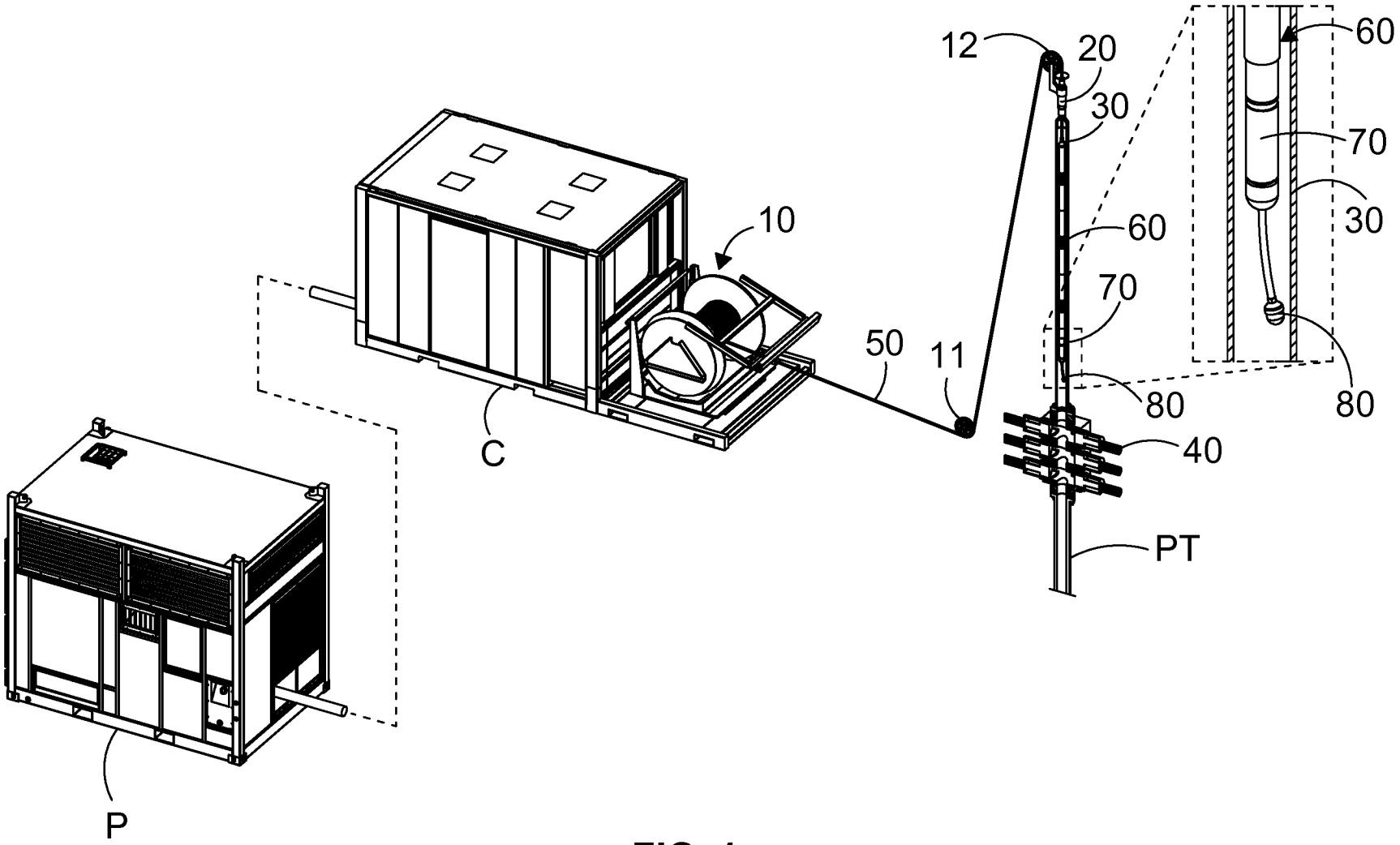
FIG. 1 shows a perspective side view of a downhole wellbore treatment system in accordance with an example of the invention in a first configuration with a first but less preferred example of a bottom hole assembly being inserted into a lubricator prior to insertion into the wellbore.

Referring now to FIG. 1, a downhole wellbore treatment system in accordance with one example of the invention comprises a pump P, a control room C and a reelable elongate conduit housed on a reel 10 in a continuous length and inserted (via lower sheave wheel 11 and upper sheave wheel 12) into a production tubing PT located in a wellbore W of an oil or gas well. The reelable elongate conduit in this example takes the form of a flexible elongate hose 50 of continuous length that is coiled onto the reel 10. The hose 50 is optionally flexible in a lateral direction, away from the axis of the hose 50, but is typically reinforced so that it is resistant to changes in length, for example elongation or compression, in response to axial forces acting on the hose 50. In addition, the hose 50 has an internal bore acting as a fluid conduit for axial passage of fluid through the hose 50. The hose 50 is typically strengthened to resist hoop stress and optionally crushing and therefore is able to resist changes in the internal diameter of the bore of the hose 50 as a result of bending of the hose 50, for example while being coiled onto the drum 10 or over sheaves when being inserted into the wellbore. The hose 50 preferably has a maximum allowable tensile load (including the hose's 50 own weight) in the region of 5500N in both pressurised and non-pressurised conditions. The hose 50 can preferably survive up to an ultimate failure load of 70,000N. The diameter of the bore 49 and the hose 50 can be in the region of ¼" to 1" and has a collapse pressure rating of in the region of 4350 psi. As a result, the hose 50 is adapted to be reeled onto the reel 10 in a single continuous length and to bend around the minimum bend radius of the reel 10, without compromising the dimensions of the hose 50. The hose 50 is, in this example, a high pressure hose, having a composite construction of an armour layer adapted to resist axial, hoop and crush stress, optionally having a polymeric coating of for example, a thermoplastic material, capable of withstanding high temperatures (and is capable of operating in the range of −40° C. up to 100° C.) and is capable of conveying high pressure fluids, for example from 1000-1100 Bar (100-110 Mpa)+/−20% at a high flow rate of around 150-300 e.g. 200 l/min measured at the topside supply pump. Optionally one particular hose that is useful for the hose 50 in this example is the product ChemJec hose 2640M-08V38 made by Parker and available from Hydrasun Limited of Aberdeen, UK. Optionally the fluid is water. The fluid conveyed in the hose 50 is pressurised by the pump P, under the control of the control room C. The hose 50 in this example has a proximal end connected to a fluid coupling on the reel 10 adapted to receive pressurised fluids from the pump P and a distal end adapted to be inserted into the production tubing PT in the wellbore W. On the distal end of the hose 50, a connector 51 (see FIG. 3) is adapted to make up a connection between the hose 50 and an upper end of a bottom hole assembly 60, the lower end of which is connected to the upper end of a turbine assembly 69 and the lower end of the turbine assembly 69 is in turn connected to the upper end of a cleaning head assembly 80 having an outlet nozzle at its lower end forming a fluid outlet in communication with the internal bore of the hose 50 through a bore in the bottom hole assembly 60. Accordingly, high pressure fluid delivered from the pump P through the hose 50 passes through the bottom hole assembly 60, turbine assembly 69 and cleaning head assembly 80 and forms a jet of high pressure fluid to clean the inner surface of the production tubing PT, as will be described below. The present example is adapted for cleaning scale from the inner surface of production tubing PT in the wellbore W but the system can be used for other treatment, e.g. cleaning the bore at the top of a downhole safety valve (not shown) located in the wellbore W, etc. Additionally and optionally, gas can be pumped through the hose 50 to aid the lifting and removal of liquid fluids and solids from the wellbore W.

Whereas the hose 50 is flexible and reelable, the bottom hole assembly 60 is optionally a rigid string of tools or subs tending not to deviate from a central axis when delivered into the wellbore W under the control of the hose 50 and suspended by the hose 50 which is adapted to bear the weight of the bottom hole assembly 60 and hose 50 when deployed into the wellbore W.

The turbine assembly 69 comprises a turbine device 65 and a swivel device incorporated in a swivel assembly 70 which permits the rotational disconnection of the cleaning head assembly 80 from the rest of the bottom hole assembly 60. The swivel assembly 70 is preferably a CJV-P8 swivel as shown in the drawings and as manufactured by Stoneage, Inc. of Durango, Colorado, USA (and which is generally disclosed in US Patent publication number US20090102189) but other suitable swivel assemblies could also be used. It should be noted that the bottom hole assembly 60 of FIG. 1 is less preferred when compared with the more preferred bottom hole assembly 160 of FIG. 6. The more preferred bottom hole assembly 160 of FIG. 6 will be described in detail subsequently.

The cleaning head assembly 80 on this example is located on the lower end of the turbine assembly 69 which in turn is located on the lower end of the less preferred bottom hole assembly 60, which enters the wellbore W first, whereas the upper end of the bottom hole assembly 60 interfaces with the connector 51 of the hose 50. In this example, the bottom hole assembly 60 incorporates a fluid conduit connecting the internal bore 49 of the hose 50 with firstly the internal bore 66, 71 on the turbine assembly 69 and secondly the internal bore 79 of the cleaning head assembly 80 at the lower end of the bottom hole assembly 60.

Figure 3:
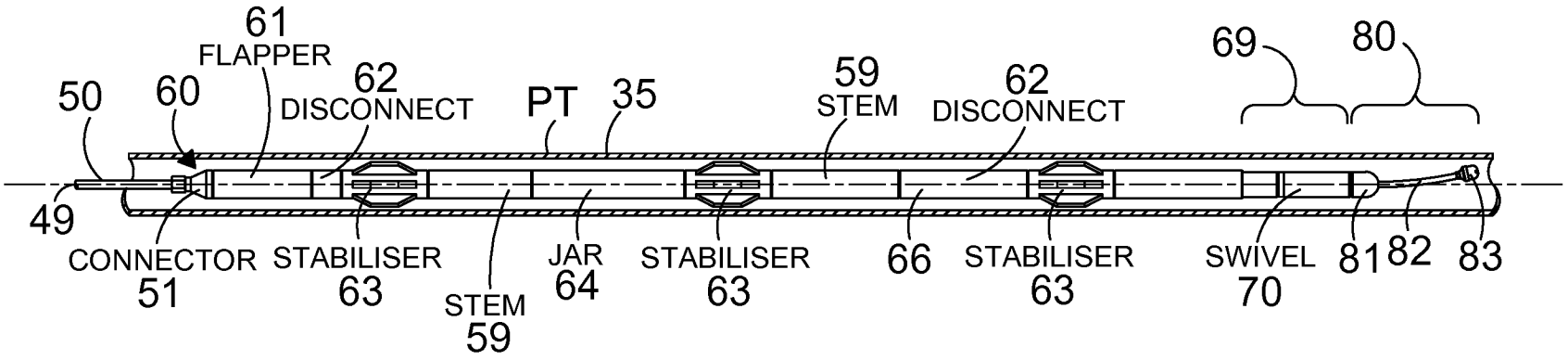
FIG. 3 shows a cutaway side view of a downhole tubular with the less preferred bottom hole assembly of FIG. 1 disposed therein.
Figure 4:
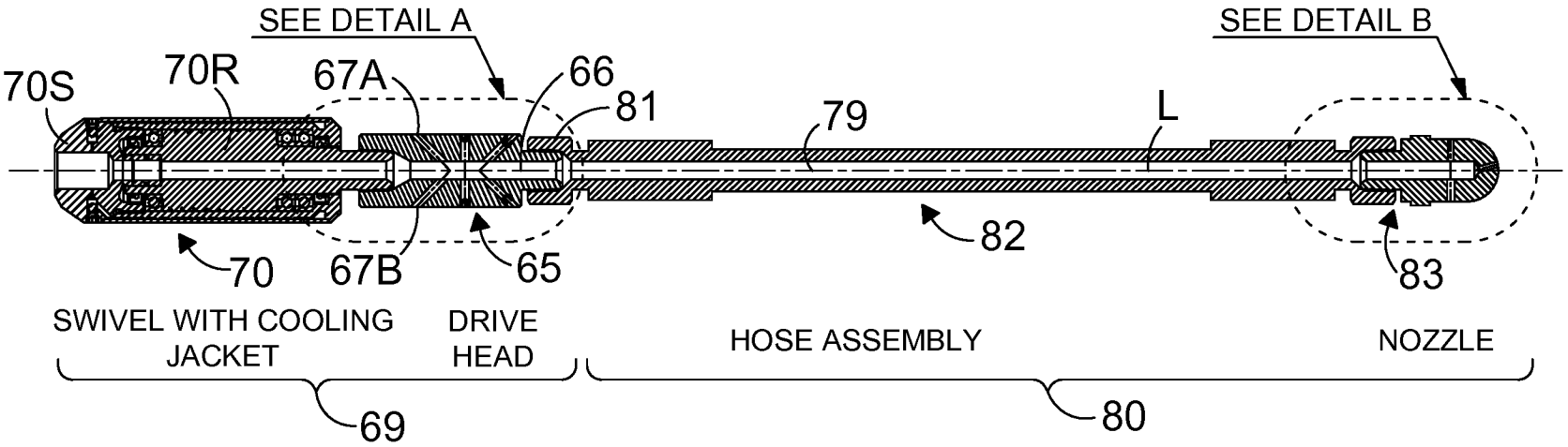
FIG. 4 shows a cross-sectional view of a cleaning head (comprising a nozzle assembly and a hose assembly) having its in use upper most end (left hand end as shown in FIG. 4) coupled to the in use lower most end (right hand end as shown in FIG. 4) of a turbine in the form of drive head which in turn has its in use upper most end coupled to the in use lower most end of a swivel which in turn has its upper most end coupled to the in use lower most end of either the less preferred bottom hole assembly of FIG. 1 or the more preferred bottom hole assembly of FIG. 6.
Figure 5A:
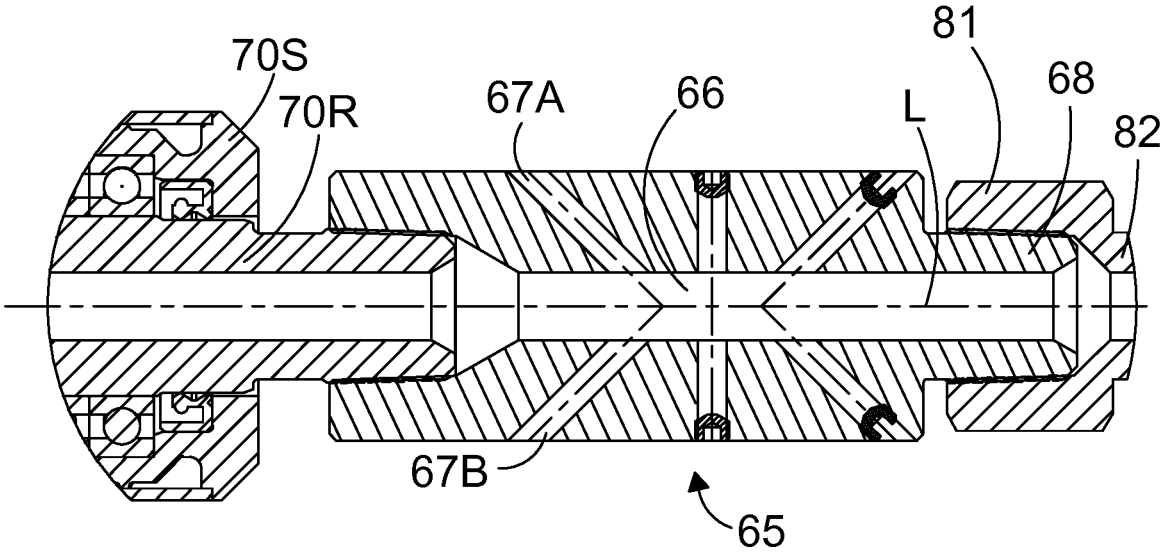
FIG. 5(*a*) shows a more detailed cross-sectional view of the drive head of FIG. 4.
Figure 5B:
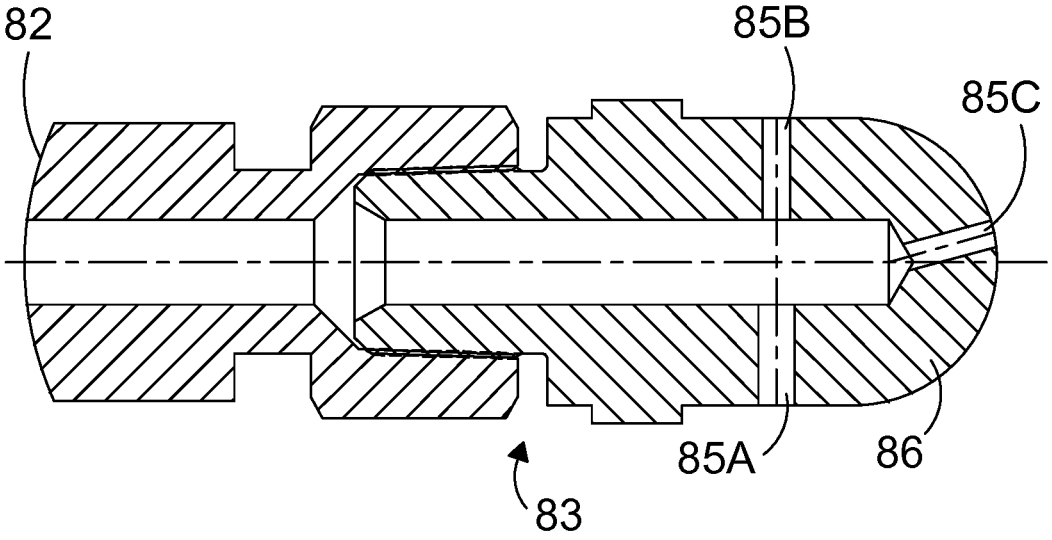

In the example shown in FIG. 1, the bottom hole assembly 60 also incorporates a number of optional features which are shown in FIG. 3. These include a one-way valve in the form of a flapper 61 which permits downward flow of fluid from the hose 50 through the bottom hole assembly 60, to the turbine assembly 69 and then to the cleaning head assembly 80, but does not permit reverse flow of fluid (neither liquid nor gas) in the opposite, upward direction. The flapper 61 therefore resists surges in wellbore pressure from being transmitted to the internal bore 49 of the hose 50.

The less preferred bottom hole assembly 60 in this FIG. 1 example also incorporates at least one disconnect tool 62 (two spaced apart disconnect tools are shown in the FIG. 3 example) allowing disconnection of upper and lower parts of the bottom hole assembly 60, for example in the event of the cleaning head assembly 80 or another lower part of the bottom hole assembly 60 or the turbine assembly 69 sticking in the production tubing PT. The lower part of the disconnect tool 62 can optionally incorporate a fishing neck or other formation adapted to facilitate recovery of the lower part in the event of an emergency disconnect procedure.

Optionally, the less preferred example of bottom hole assembly 60 in FIG. 3 incorporates a jarring device 64, which can be actuated from the surface to impart a sudden force acting to jar the bottom hole assembly 60 loose in the event of sticking in the wellbore W.

Also, the less preferred example of the bottom hole assembly 60 in FIG. 3 optionally incorporates at least one stabiliser 63, which helps to centralise the bottom hole assembly 60 within the production tubing PT and to maintain a minimum standoff between the outer surface of the bottom hole assembly 60 and the inner surface of the production tubing PT. Also, one or more weight stems 59 (two are shown in FIG. 3) provide weight to the bottom hole assembly 60 in order to assist in running in of the bottom hole assembly 60 into the wellbore W.

Figure 6:
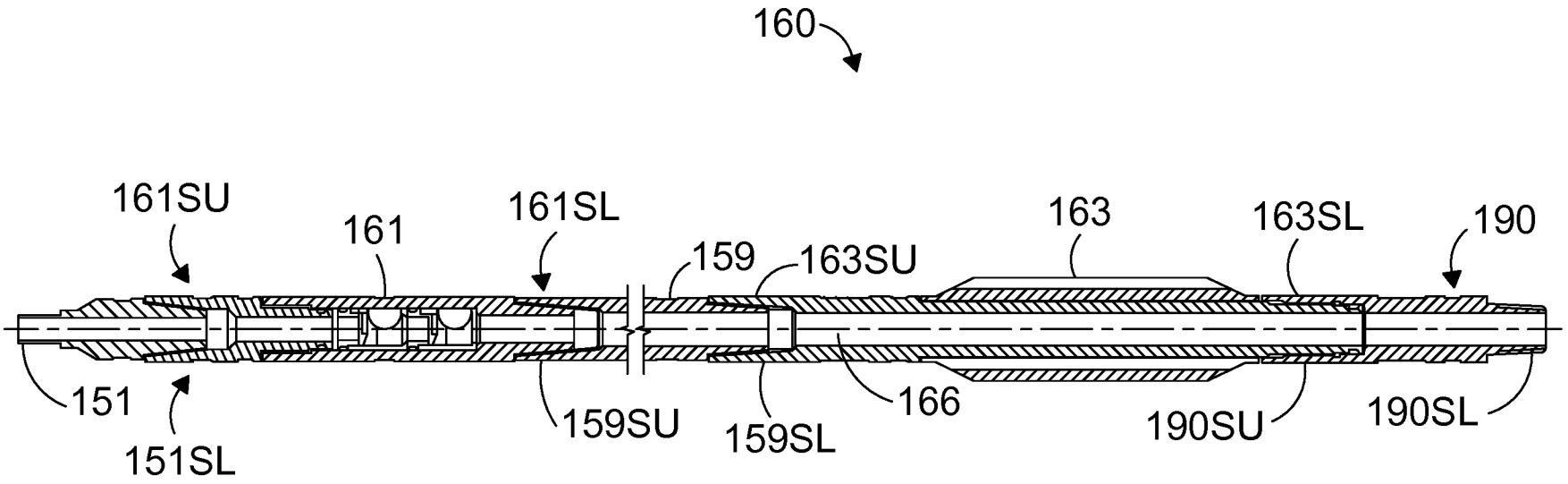
FIG. 6 shows a cross-sectional side view of a more preferred bottom hole assembly for use in the downhole wellbore treatment system in accordance with the present invention, where the more preferred bottom hole assembly of FIG. 6 is preferred more than the bottom hole assembly shown in FIG. 1.
Figure 7A:
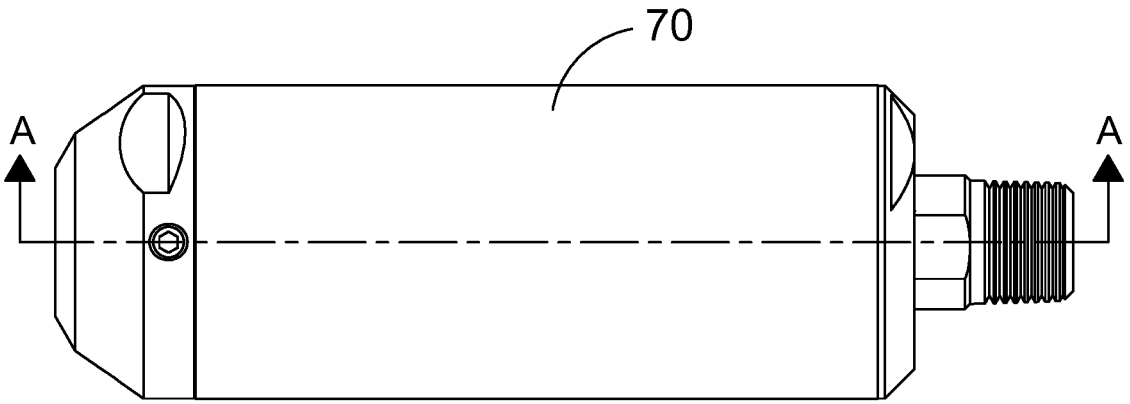
FIG. 7(*a*) is a side view of the swivel of FIG. 4 in a first rotational orientation.
Figure 7B:
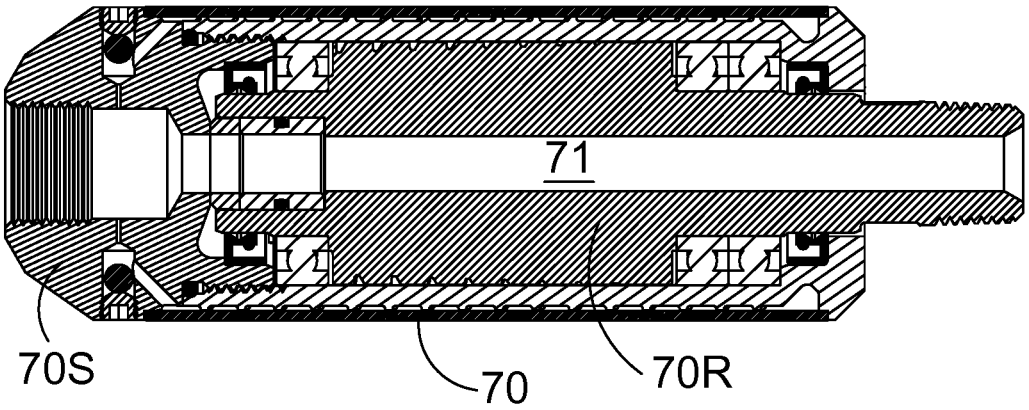
Figure 8A:
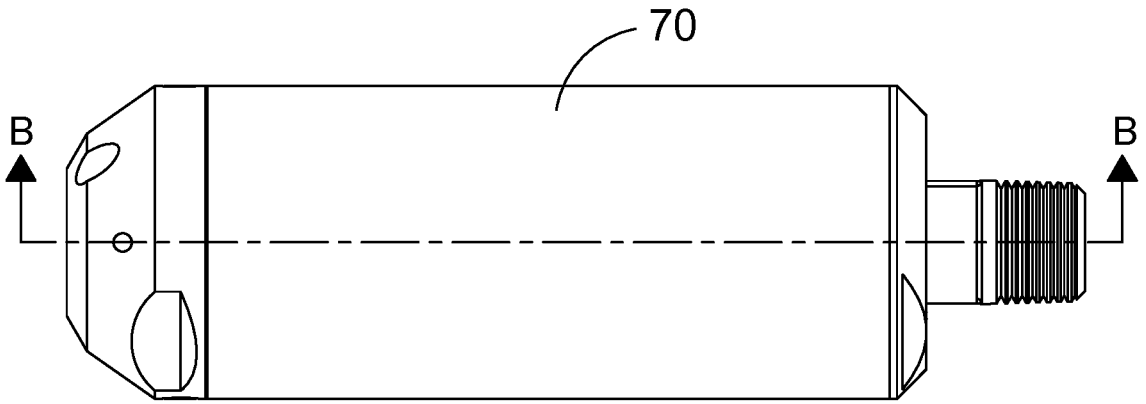
FIG. 8(*a*) is a side view of the swivel of FIG. 4 in a second rotational orientation.
Figure 8B:
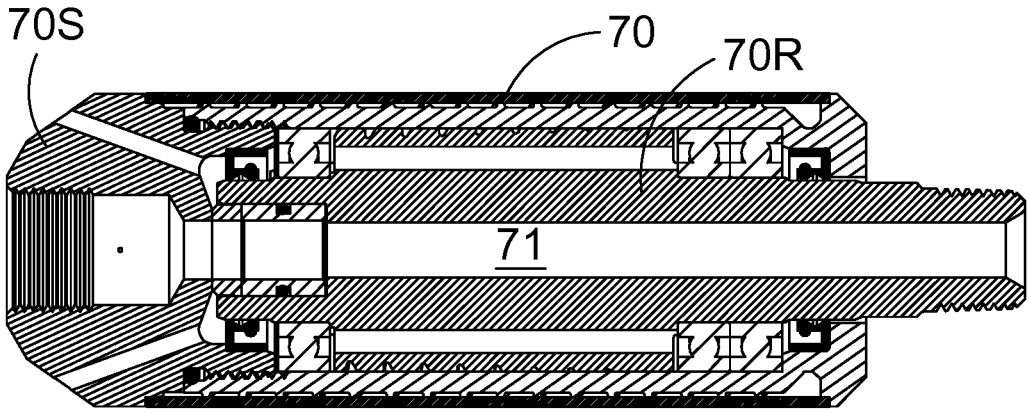
Figure 9A:
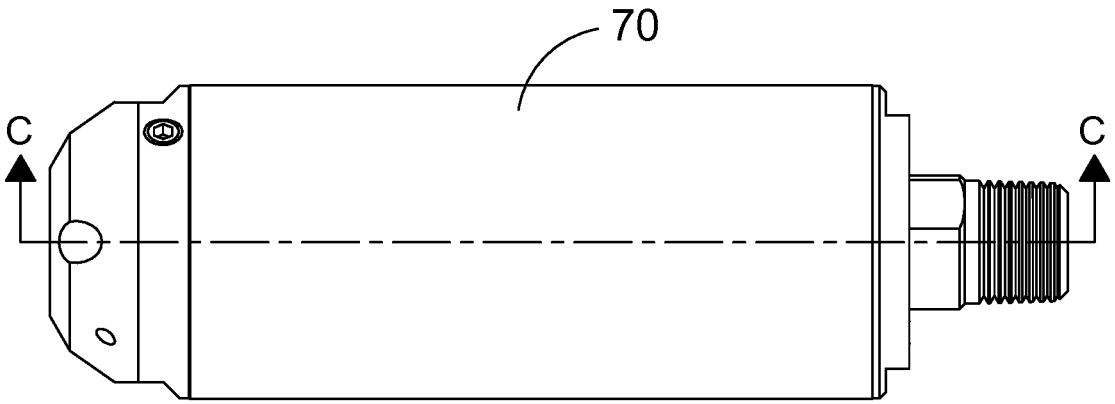
FIG. 9(*a*) is a side view of the swivel of FIG. 4 in a third rotational orientation.
Figure 9B:
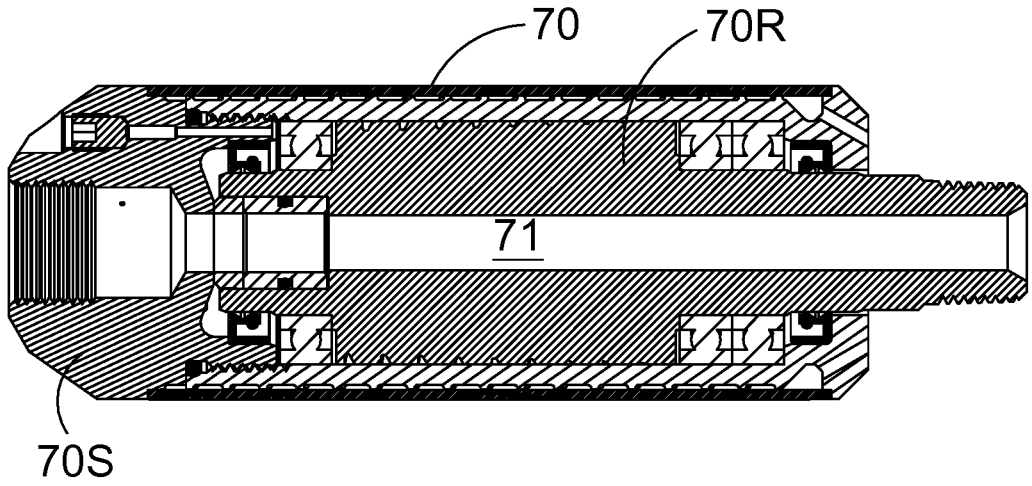
Figure 10:
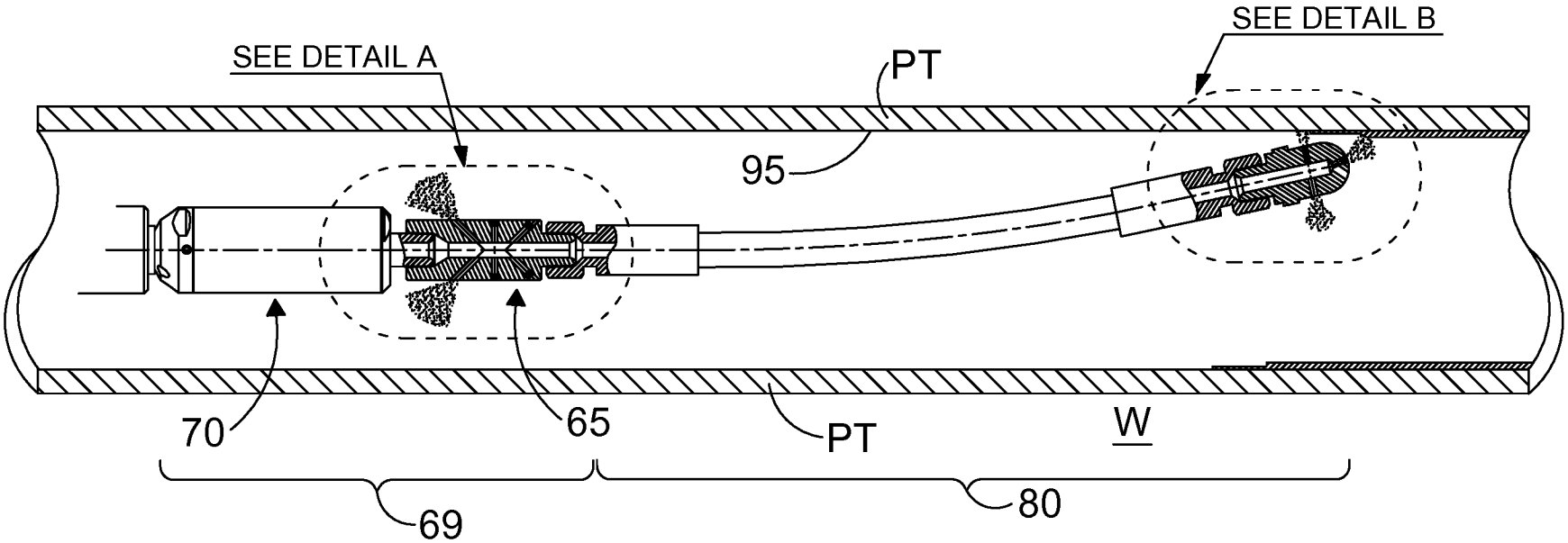
FIG. 10 is a part cross-sectional side view of the cleaning head, drive head and swivel of FIG. 4 in operation downhole whilst cleaning the inner throughbore of a section of production tubing.
Figure 11:
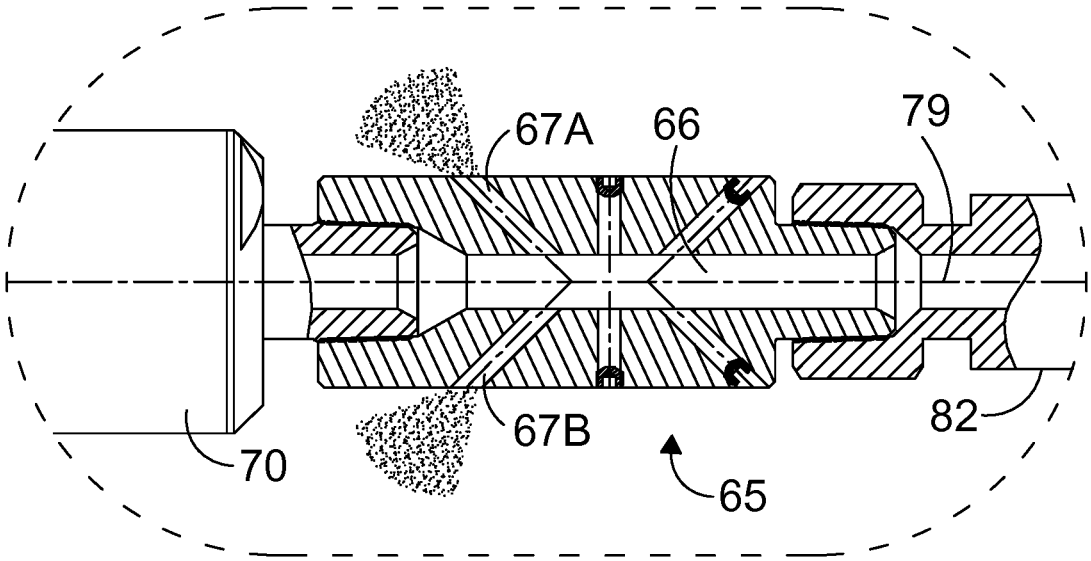
FIG. 11 is a detailed part cross-sectional side view of DETAIL A area of FIG. 10, showing the drive head coupled to the swivel.

A more preferred bottom hole assembly 160 is shown in FIG. 6 and in use, in the bottom hole assembly 160 is more preferred to the bottom hole assembly 60 of FIG. 1. To aid clarity, like components between the bottom hole 160 of FIG. 6 and the bottom hole assembly 60 of FIG. 3 use the same reference number but those components used in the more preferred bottom hole assembly 160 are indicated with the addition of 100. The more preferred bottom hole assembly 160 comprises at its upper most in use end a connector 151 for connecting to the lower end of the hose 50 (not shown in FIG. 6), where the lower end of the connector 151 comprises a suitable screw thread 151SL for screw threaded connection to a suitable screw thread 161SU the upper end of a suitable valve such as a check valve 161 or flapper 161 and which operates in the same manner as the flapper 61 of FIG. 3. The lower end of the check valve 161 has a suitable screw thread 161SL which is connected to a suitable screw thread 159SU at the upper end of a weight stem 159 and the lower end of the weight stem 159 is provided with a suitable screw thread 159SL for screw threaded connection with 163SU at the upper end of a stabiliser 163. The lower end of the stabiliser 163 is provided with a screw thread 163SL for screw threaded connection to a screw thread 190SU at the upper end of a connector 190 which in turn is provided with a suitable screw thread 190SL at its lower end for screw threaded connection with the upper end of the swivel 70 (not shown in FIG. 6 but shown in FIG. 7(*b*)).

The turbine assembly 69 also incorporates a turbine device 65 in the form of a drive head 65 attached to the swivel assembly 70. The through bore 66 of the turbine device 65 is in fluid communication with the through bore of either the less preferred bottom hole assembly 60 or the more preferred bottom hole assembly 160 (depending upon which bottom hole assembly 60 or 160 is deployed by the operator into the wellbore W) and is driven in rotation by passage of pressurised fluid through the bore of the bottom hole assembly 60, 160 and into the through bore 66, 166 such that the fluid either or both of acts upon suitable rotation means such as a helical spiral (not shown) provided in the throughbore of the turbine 65 and/or the nozzle assembly 83 or by virtue of the arrangement of angled nozzle 85C causing the said rotation as the fluid exits therethrough. In addition, or alternatively, the skilled person will realise that other suitable arrangements and methods for causing rotation of the turbine 65 and/or the cleaning head assembly 80 could be used, including incorporating a suitable rotation generation mechanism (not shown) within the swivel 70.

It will also be noted that said thrust ports 67A, 67B are angled, most preferably at 45 degrees to the longitudinal axis L and directed back toward the surface, away from the most downhole or distal end of the cleaning head assembly 80, and thus the thrust ports 67A, 67B can assist with keeping the drive head 65 directed downwards within the production tubing PT.

In any event, the pressurised fluid exiting the said port 85C causes the turbine device or drive head 65 and thus the rotor part 70R of the swivel 70 (by virtue of its screw threaded connection thereto) on one end and the cleaning head assembly 80 on the other end to rotate (with respect to the non-rotating stator part 70S of the swivel 70, the BHA 60, 160 and the hose 50). Typical speeds of rotation are around 30-100 rpm. In this example, the turbine device 65 incorporates an output shaft 68 which is screw threaded connected to the cleaning head assembly 80, so that the flow of pressurised fluid through the bore of the bottom hole assembly 60, 160 drives rotation of the turbine device 65, which rotates the cleaning head assembly 80 as a result. Accordingly, passage of the fluid under pressure through the bottom hole assembly 60, 160 drives rotation of the cleaning head assembly 80, in addition to passing through the cleaning head assembly 80 and the outlet nozzle assembly 83 in order to form the jet of cleaning fluid that cleans the inner surface of the production tubing PT. In addition, because the thrust ports 67A, 67B are back angled toward the surface, the force of the jet of the treatment fluid exiting through the ports 67A, 67B creates thrust acting upon the drive head 65

(and thus the BHA 60 or 160 and hose 50) and thus can drive the drive head 65 through the wellbore W whilst cleaning treatment is occurring as will be described subsequently.

Figure 12:
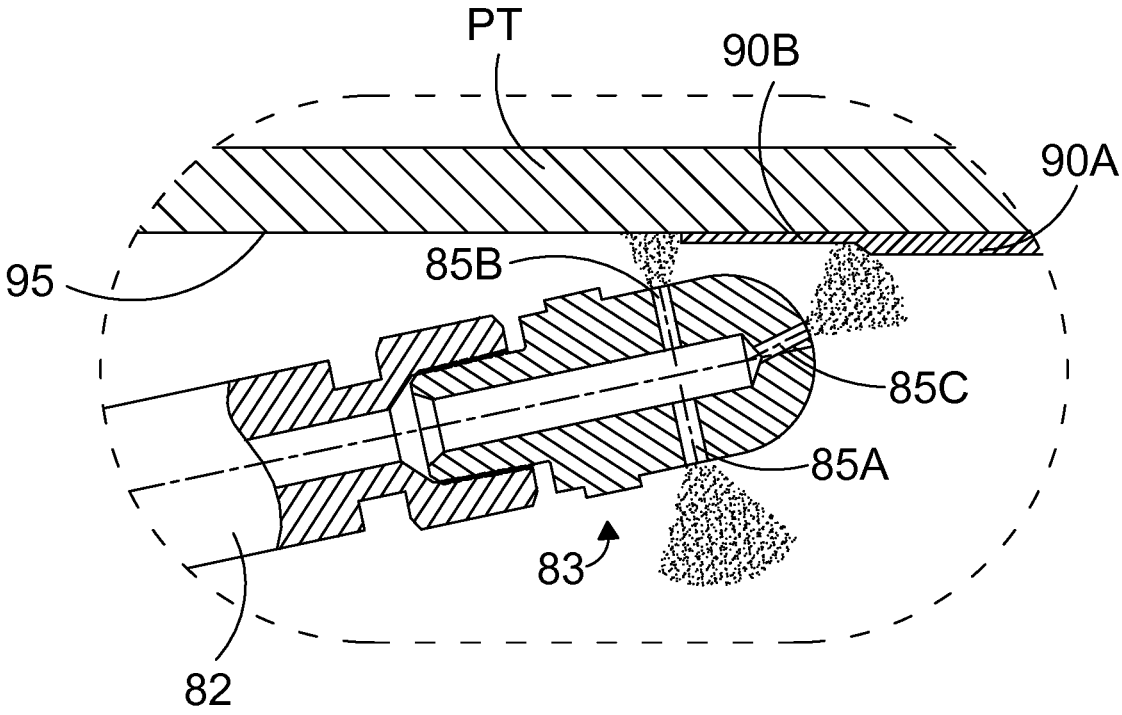
FIG. 12 is a detailed part cross-sectional side view of DETAIL B area of FIG. 10, showing the nozzle assembly during a cleaning operation.
Figure 13:
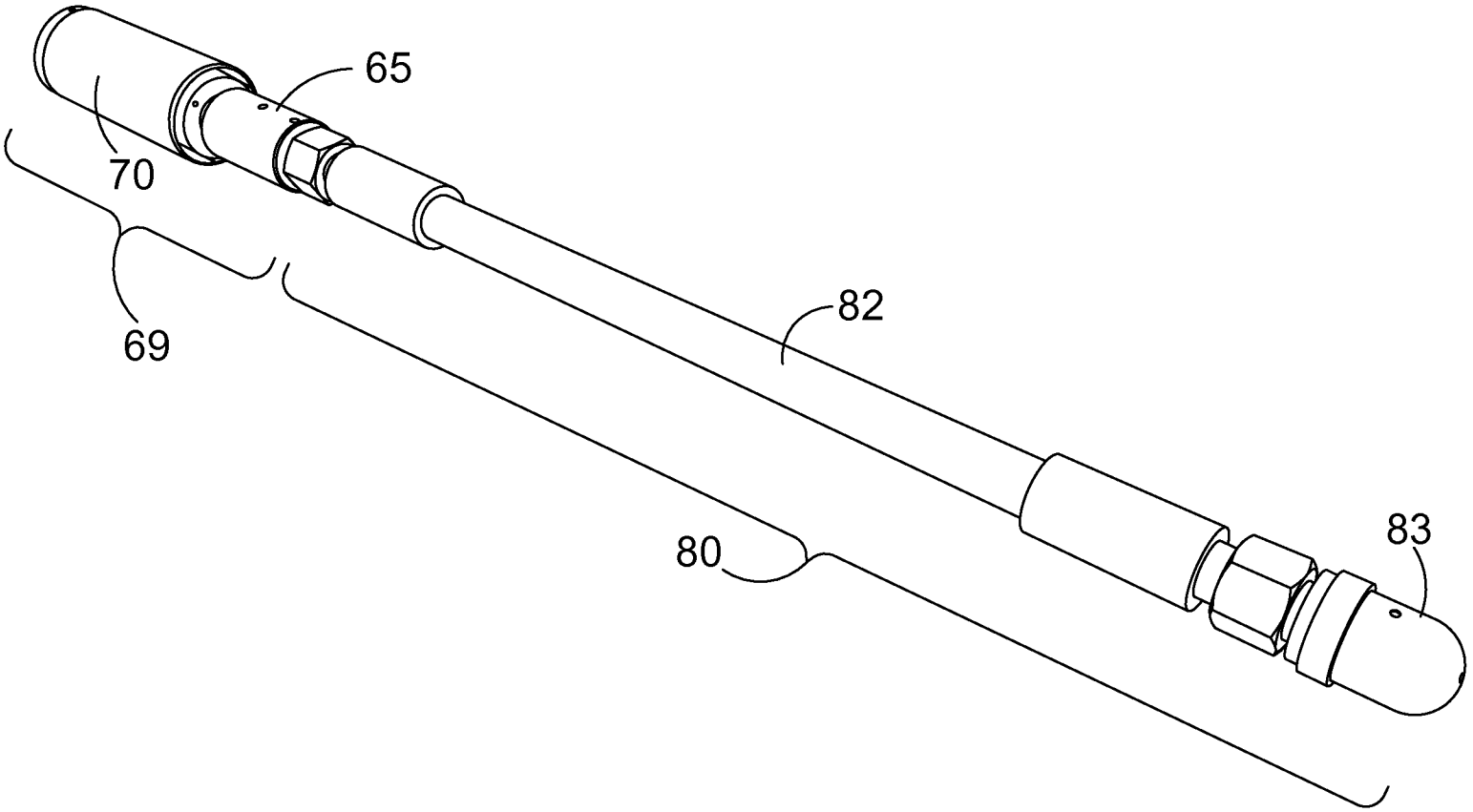
FIG. 13 is a perspective side view of the cleaning head, drive head and swivel of FIG. 4.
Figure 14:
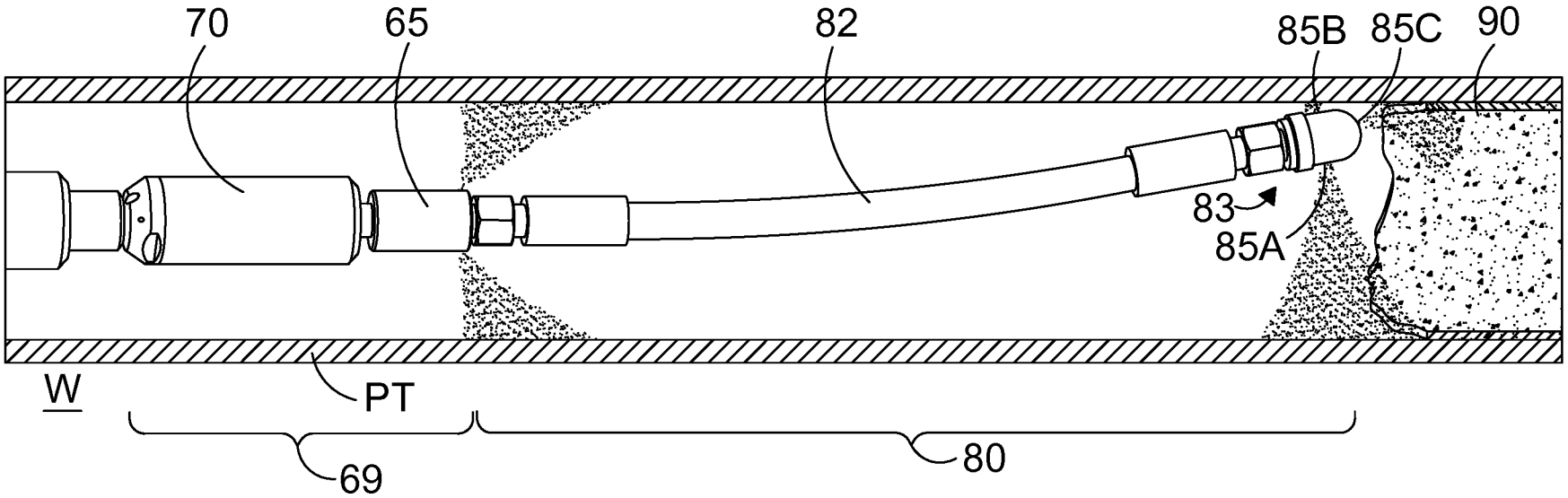
FIG. 14 is a perspective side view of the cleaning head, drive head and swivel of FIG. 10 in operation downhole whilst cleaning the inner throughbore of the section of production tubing.

The cleaning head assembly 80 comprises a screw threaded upper end connector 81 attached to the screw threads provided on the output shaft 68 of the lower end of the drive head 65, a short length of semi-rigid flexible whip hose 82 of around 5 cm to 50 cm in length (and which is preferably formed from the same type of hose as the hose 50) and a nozzle assembly 83, which incorporates the arrangement of the outlet nozzles 85A, 85B, 85C, all of which are rotationally connected so that rotation of the end connector 81 with respect to the stator 70S of the swivel assembly 70 rotates the hose 82 and nozzle assembly 83 around the axis L of the bottom hole assembly 60 or 160. The length of the hose 82 can optionally be related to the diameter of the production tubing PT being cleaned and optionally the length of the hose 82 is sufficient to permit bending of the hose 82 from the end connector 81 connected to the centralised bottom hole assembly 60 or 160 to allow the nozzle assembly 83 to reach the inner surface of the wall of the production tubing PT. In this case, the length of the hose is approximately 100-300% e.g. 130-200% or approximately 150-160% of the radius of the production tubing PT. The bore of the hose 82, the end connector 81 and the outlet nozzles 85A, 85B, 85C on the nozzle assembly 83 are all in fluid communication with the bore of the bottom hole assembly 60 or 160, so that fluid flowing from the hose 50 into the bottom hole assembly 60 or 160 flows into the end connector 81, hose 82 and nozzle assembly 83 and out of the outlet nozzles 85A, 85B, 85C. In some examples, the outlet nozzles of the nozzle assembly 83 is aligned with the axis of the hose 82, but in this preferred example one radial thrust nozzle 85A comprises a larger diameter through bore than the other nozzles 85B, 85C and furthermore is disposed perpendicularly in a side wall 86 of the nozzle assembly 83, so that the jet of pressurised fluid from the larger outlet radical thrust nozzle 85A is directed perpendicularly into the middle of the through bore of the production tubing (PT) and which forces or thrusts the entire nozzle assembly 83 off the longitudinal central axis L of the bottom hole assembly 60 or 160 and further thrusts the nozzle assembly 83 radially outwardly from the longitudinal axis L and towards the inner surface of the production tubing PT whilst the radial thrust nozzle 85A will continue pointing towards the longitudinal axis L and which also forces the opposite side of the nozzle assembly 83 (i.e. the side having the smaller diameter cleaning nozzle 85B) against the inner surface of the production tubing PT and therefore ensures that the pressurised fluid exiting the cleaning nozzle 85B immediately contacts the second layer of scale 90B (as can be seen in FIG. 12) to be cleaned from the inner surface of the production tubing PT, thereby significantly increasing the cleaning capability of the nozzle assembly 83. A second cleaning nozzle 85C is formed at the leading (or most downhole) end of the nozzle assembly 83 and which is preferably angled by approximately 10-20 degrees from the axis L in the direction of the first cleaning nozzle 85B and which cleans the first layer of scale 90A as can be seen in FIG. 12 (and also as described above, assists with causing rotation of the cleaning head assembly 80, drive head 65 and rotor 70R of the swivel 70 with respect to the stator 70S, BHA 60, 160 and the hose 50).

In the present example and as briefly discussed above, the drive head 65 incorporates at least one and preferably at least a pair of thrust or drive ports 67A, 67B in fluid connection with the bore of the hose 50 and hose 82, which create a jet of cleaning fluid directed uphole in a general direction towards the bottom hole assembly 60 or 160 and the BOP 40. It will be noted that directional indications such as "up" or "uphole" in the context of the wellbore W means towards the wellhead and the surface and could apply in horizontal wells to directions which are not necessarily directly above the wellbore. Similarly, directions referred to herein as "down" or "downhole" directions, refer to movement deeper into the wellbore W, away from the surface and the wellhead. In this example, the drive ports 67A, 67B each have a bore which extends at an angle, i.e. greater than 0° and less than 90°, optionally having a radial component and an axial component with respect to the main longitudinal axis L of the drive head 65 and the flexible hose 82, for example, approximately 45° and hence fluid jetting from the drive ports 67A, 67B is directed radially outwardly and in an uphole direction, with respect to the downhole direction of advance of the bottom hole assembly 60 or 160 into the wellbore W. The angle and bore dimensions of the drive ports 67A, 67B can be selected to provide a net reaction force of the thrust or drive ports 67A, 67B from the drive head 65 and the outlet nozzles 85A, 85B, 85C acting to drive the nozzle assembly 83 further downhole into the wellbore W, away from the wellhead and BOP 40 during cleaning. The dimensions and angles of the nozzles 85A, 85B, 85C and particularly the bore dimension of the drive ports 67A, 67B, can be selected to provide different levels of force driving the nozzle assembly 83 forwards in the bore W. In the present example, the force of the fluid jet from the drive ports 67A, 67B and from the outlet nozzles 85A, 85B, 85C accomplishes at the same time both the axial advancement of the nozzle assembly 83 deeper into the wellbore W and cleaning the scale 90 from the internal surface 95 of the production tubing PT/wellbore W at the same time. Optionally, the angle of the drive ports 67A, 67B with respect to the whip hose 82 can be adjusted (i.e. decreased) in order to provide a larger component of axial reaction force derived from the drive head 65, at the expense of its radial component of force, providing better drive characteristics as required.

The uphole oriented angle of the drive ports 67A, 67B also jets particulate material away from the cleaning head assembly 80 and washes it up the annulus between the bottom hole assembly 60 or 160 and the inner surface of the production tubing PT, for recovery to surface.

Figure 2:
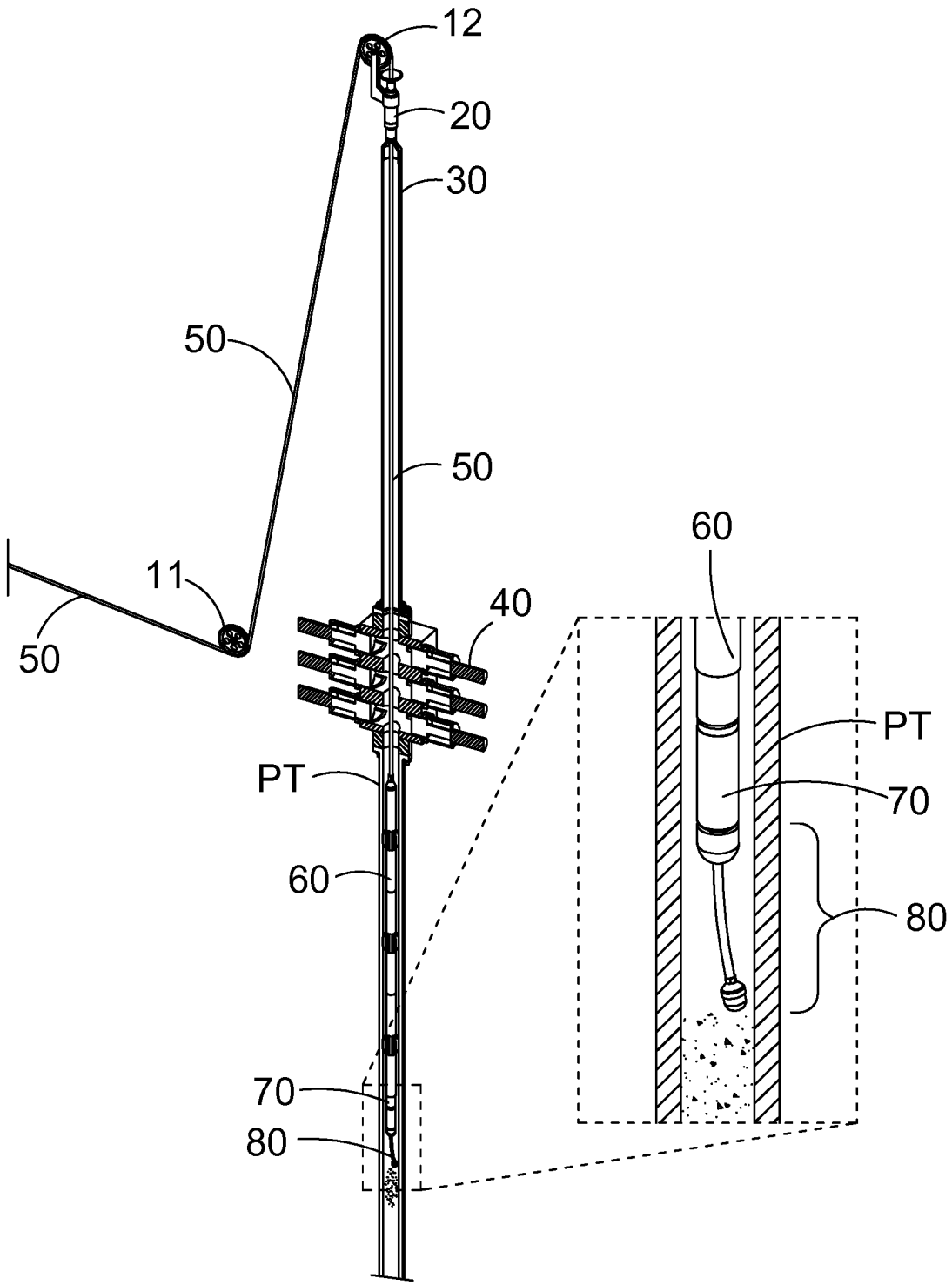
FIG. 2 shows a schematic view of the lubricator and wellbore of FIG. 1 after insertion of the less preferred bottom hole assembly of FIG. 1 into the wellbore.

In operation, either the bottom hole assembly 60 or more preferably the bottom hole assembly 160, with the attached turbine assembly 69 and the cleaning head assembly 80 is inserted into the lubricator 30, optionally through the stuffing box 20, with the BOP 40 open and the christmas/xmas tree (located below the BOP 40 but not shown in either of FIG. 1 or 2) closed, thereby retaining wellbore pressure within the well. While the christmas tree is still closed, the hose 50 is optionally connected via connector 151 to the upper end of the bottom hole assembly 160 in the lubricator 30, being passed through the stuffing box 20 before making the connection. Alternatively, and preferably, the hose 50 and the bottom hole assembly 160 are connected outside of the lubricator 30 and the connected assembly is offered through the stuffing box 20 into the lubricator 30, again with the christmas tree closed. Once the bottom hole assembly 160 is located within the lubricator 30 and is connected to the hose 50 and the seals on the stuffing box 20 are closed to contain wellbore pressure, the christmas tree is opened and the bottom hole assembly 160 can be advanced into the production tubing PT to clean scale 90 from its inner surface 95. Further alternatively, the BOP 40 may initially be closed (instead of the xmas tree particularly if there is no Xmas tree present) in order to contain the wellbore pressure. In this example, the wellbore W is lined with casing (not shown) and production tubing PT is installed inside the casing but the apparatus can be used to treat the inner surface of other downhole tubulars, such as casing, liner, drill pipe etc.

To drive the bottom hole assembly 160 into the wellbore W, pressurised fluid is injected through the hose 50 and the bottom hole assembly 60, discharging through thrust or drive ports 67A, 67B and also through the nozzles 85A, 85B, 85C in the nozzle assembly 83 of the cleaning head 80, which is driven in rotation by the turbine device 65 around the axis L of the swivel in the swivel assembly 70. Gravity also assists in pulling the BHA 60 into the wellbore W, particularly due to the inclusion of the weight stem 163. The pressurised fluid is delivered at high pressure through the outlet cleaning nozzles 85B, 85C and the radial thrust nozzle 85A in the nozzle assembly 83 of the cleaning head 80.

The fluid jetting through the radially extending cleaning outlet nozzles 85B, 85C cleans the scale 90 from the inner surface 95 of the production tubing PT and the reaction force created by the pressurised fluid exiting the radial thrust nozzle 85A holds the nozzle assembly 83 against the inner surface 95 of the production tubing PT. The fluid jetting through the drive or thrust ports 67A, 67B extending uphole at an angle with respect to the axis L of the hose 50 creates a reaction force tending to advance the cleaning head 80 in a downhole direction into the production tubing PT, thereby pulling the bottom hole assembly 60 and the hose 50 to which it is attached, deeper into the production tubing PT. It should however be noted that thrust ports 67A, 67B need not be used in certain operations (particularly for substantially vertical wells and/or when only the upper portion of the wellbore W requires to be cleaned) in which case the operator can (particularly due to the presence of weight stems 59 or 159) rely on gravity to lower the BHA 160 into the wellbore W and in such a case, the thrust ports 67A, 67B can be blanked off or otherwise blocked.

The pressure of the fluid injected can be controlled from the control cabin C at the surface, to increase the speed of advance of the bottom hole assembly 60 into the production tubing PT, by increasing the force of the drive jet.

The fluid pressure is typically maintained continuously through the cleaning operation, causing cleaning of the production tubing PT and continuous advance of the cleaning head 80 through the production tubing PT while cleaning takes place. This continuously reels the hose 50 from the reel 10 at the surface, which unspools gradually at a speed dictated by the rate of advance of the cleaning head 80.

The present example permits continuous cleaning of the entire production tubing PT from the initial stages when the cleaning head 80 has passed the BOP 40, through to the lower reaches of the production tubing PT limited only by the length of the hose 50. The hose 50 can typically be provided in lengths of up to 2500 m. If desired, the length of hose 50 on the reel 10 at the surface can be spliced with further reels in order to permit additional reach of the system further into the production tubing PT.

During changeover of the hose 50 at the surface, the hose 50 can optionally be reeled in by reversing the reel 10 by a short distance to withdraw the bottom hole assembly 160 uphole for the same short distance back into the previously-cleaned section of the production tubing PT. This is advantageous because following the connection of the additional reel at the surface, the cleaning process can start from the previously-cleaned section of the production tubing PT so that sections of the production tubing PT are not missed out during the cleaning process even when changeovers are needed at the surface.

Modifications and improvements can be made to the embodiments hereinbefore described without departing from the scope of the invention which is defined in the claims.

The invention claimed is:

1. A downhole wellbore treatment system for treating an inner surface of a wellbore, the system comprising:

an elongate conduit having a central longitudinal axis for conveying treatment fluid from the surface to a treatment head adapted to be inserted into the wellbore, the treatment head having a central longitudinal axis and a first outlet nozzle and a second outlet nozzle providing an outlets from the conduit for creating a jet of treatment fluid directed at the inner surface of the wellbore, wherein the treatment head is rotationally disconnected from the conduit by a swivel device, allowing rotation of the head relative to the conduit during jetting of the treatment fluid, wherein the treatment head comprises said first and second outlet nozzles and a flexible hose and the said first and second outlet nozzles are connected to the conduit by the flexible hose, wherein the system incorporates a turbine assembly which comprises the said swivel device and a turbine disposed in fluid communication with the conduit and the treatment head, wherein the treatment head is connected to the turbine assembly by the said flexible hose such that the treatment head is in fluid communication with the conduit via the turbine assembly whereby flow of fluid through the conduit drives the turbine to rotate the treatment head relative to the conduit;

wherein the treatment head further includes at least one radial thrust nozzle, wherein the force of the pressure of the treatment fluid within the elongate conduit exiting the radial thrust nozzle is operable to thrust the treatment head off the longitudinal central axis of the elongate conduit and thus forces the first and second outlet nozzles toward the inner surface of the wellbore, wherein the first outlet nozzle is an aperture formed through a sidewall provided on one side of the treatment head and the radial thrust nozzle is an aperture formed through a sidewall provided on a second side of the treatment head, and wherein the second outlet nozzle is an aperture formed at the leading, most downhole, end of the treatment head and which is angled from the longitudinal central axis of the treatment head in the direction of the first outlet nozzle, and wherein the elongate conduit is reelable and is inserted into the downhole wellbore from a reel at the surface, through a pressure control device containing wellbore pressure within the downhole wellbore during insertion of the elongate conduit from the reel.

2. The treatment system according to claim 1, wherein the pressure control device comprises at least one of a stuffing box, a lubricator and a BOP.

3. The treatment system according to claim 1, wherein the treatment head is disposed on a bottom hole assembly on the end of the elongate conduit and wherein the bottom hole assembly comprises at least one of a one-way valve, a weighted component and a stabiliser.

4. The treatment system according to claim 1, wherein the elongate conduit is flexible.

5. The treatment system according to claim 1, wherein the elongate conduit comprises coiled tubing.

6. The treatment system according to claim 1, wherein the elongate conduit comprises a flexible hose.

7. The treatment system according to claim 1, wherein the elongate conduit is operable to convey gas such that gas can be pumped through the elongate conduit to thereby clean the wellbore and provide a means of artificial lift to at least one of the liquids and/or solids located in the wellbore by using said gas.

8. The treatment system according to claim 1, wherein the turbine includes at least one drive nozzle adapted to create a jet of pressurised fluid directed away from a distal end of the treatment head, wherein force created by the jet of treatment fluid from the at least one drive nozzle drives the treatment head through the wellbore.

9. The treatment system according to claim 8, wherein the net reaction force of the drive nozzle and the first and second outlet nozzles drives the treatment head through the wellbore.

10. The treatment system according to claim 8, wherein the drive nozzle has a bore which extends at an angle greater than 0° and less than 90° with respect to the main axis of the turbine.

11. The treatment system according to claim 1, wherein the diameter of the first outlet nozzle is smaller than the diameter of the radial thrust nozzle.

12. The treatment system according to claim 1, wherein the treatment head comprises a substantially cylindrical shape.

13. The treatment system according to claim 1, wherein the first outlet nozzle is substantially opposite the radial thrust nozzle with reference to the longitudinal central axis of the treatment head.

14. A method of treating an inner surface of a wellbore, the method comprising:

providing a reelable elongate conduit having a central longitudinal axis and comprising: — a treatment head provided at the lower end thereof, the treatment head having a central longitudinal axis and being in fluid communication with the elongate conduit, the treatment head comprising:

a first outlet nozzle comprising an aperture formed through a sidewall provided on a first side of the treatment head;

at least one radial thrust nozzle comprising an aperture formed through a sidewall provided on a second side of the treatment head;

a second outlet nozzle comprising an aperture formed at the leading, most downhole, end of the treatment head and which is angled from the longitudinal central axis of the treatment head in the direction of the first outlet nozzle; and a flexible hose, whereby first outlet nozzle, the second outlet nozzle and the radial thrust nozzle are connected to the conduit by the flexible hose, and a turbine assembly disposed in fluid communication with the conduit and the treatment head, whereby the turbine assembly comprises a turbine and a swivel device and whereby the turbine assembly is connected to the treatment head by the flexible hose such that the treatment head is in fluid communication with the conduit via the turbine assembly;

inserting the elongate conduit into the wellbore from a reel at the surface, through a pressure control device containing wellbore pressure within the wellbore during insertion of the elongate conduit into the wellbore;

advancing the elongate conduit into the wellbore, conveying treatment fluid from the surface to the treatment head through the elongate conduit, and thereafter through the turbine assembly and thereby rotating the treatment head relative to the elongate conduit during treatment;

conveying said treatment fluid from the at least one radial thrust nozzle on the treatment head to thrust the treatment head off the longitudinal central axis of the elongate conduit and thus force the first and second outlet nozzles toward the inner surface of the wellbore; and jetting said treatment fluid from the first and second outlet nozzles on the treatment head at the inner surface of the wellbore whilst the treatment head is rotating.

15. The method according to claim 14, comprising the further step of using the force from the pressure of the treatment fluid within the elongate conduit to propel the elongate conduit and treatment head through the wellbore being cleaned and treating the inner surface of the wellbore.

16. The method according to claim 15, comprising jetting treatment fluid from a drive nozzle on the turbine to drive the treatment head through the wellbore.

17. The method according to claim 14, comprising the further step of pumping gas through the elongate conduit to provide an artificial lift to at least one of the liquids and/or solids located in the wellbore to thereby aid the lifting and removal of liquids and/or solids from the wellbore.

* * * * *